US006572167B2

(12) United States Patent
Deininger

(10) Patent No.: US 6,572,167 B2
(45) Date of Patent: Jun. 3, 2003

(54) GOLF BALL DISPENSING AND RETRIEVING SYSTEM

(75) Inventor: Eric I. Deininger, Highland Beach, FL (US)

(73) Assignee: Dorson Sports, Inc., Ronkonkoma, NY (US)

( * ) Notice: Subject to any disclaimer, the term of this patent is extended or adjusted under 35 U.S.C. 154(b) by 0 days.

(21) Appl. No.: 10/120,699

(22) Filed: Apr. 11, 2002

(65) Prior Publication Data

US 2002/0171253 A1 Nov. 21, 2002

Related U.S. Application Data

(63) Continuation of application No. 09/614,097, filed on Jul. 11, 2000, now Pat. No. 6,386,607.

(51) Int. Cl.[7] ..... A63B 47/02
(52) U.S. Cl. ..... 294/19.2
(58) Field of Search ..... 294/19.2; 473/132, 473/137; 221/185, 194, 195, 196, 199, 299, 301

(56) References Cited

U.S. PATENT DOCUMENTS 1,937,180 A * 11/1933 Young ..... 221/298
1,940,321 A * 12/1933 Pagett ..... 221/301
3,966,051 A * 6/1976 Hollister et al. ..... 211/14
4,575,092 A * 3/1986 Watson ..... 473/137
4,589,661 A * 5/1986 Attig ..... 473/133
5,346,222 A * 9/1994 Luther, Sr. ..... 473/137
5,458,339 A * 10/1995 Wildes ..... 473/136

* cited by examiner

*Primary Examiner*—Dean J. Kramer
(74) *Attorney, Agent, or Firm*—Furgang & Adwar, LLP

(57) ABSTRACT

A combination golf ball retriever and dispenser comprises a shag bag and two tubes. The first tube is a conventional golf ball retrieving tube which may be screwed into a collar at the base of the bag. Golf balls retrieved through the tube may be stored in the bag by inverting the retrieving tube. Stored golf balls may be dispensed by removing the retrieving tube and screwing into its place a dispensing tube on an extending collar which surrounds a hole at the bottom of the bag. A selective dispenser is secured to the end of the second leg and comprises a pivotally mounted spring loaded bar having two prongs. A pivotally secured lever arm may press down on the arm thereby compressing the spring and moving one prong out of the interior of the second leg and the second prong through the slot and into the interior of the second leg.

11 Claims, 4 Drawing Sheets

GOLF BALL DISPENSING AND RETRIEVING SYSTEM

CROSS-REFERENCE TO RELATED APPLICATION

This application is a continuation of application Ser. No. 09/614,097, filed Jul. 11, 2000 now U.S. Pat. No. 6,386,607.

FIELD OF THE INVENTION

This invention relates generally to systems and apparatus used as an accessory for sporting games. More particularly, the invention relates to a portable package and system for picking up and dispensing golf balls. The present invention is particularly, though not exclusively, useful for gathering or retrieving golf balls and then dispensing the golf balls one by one so that the user may, for example, practice with or make some other use of the dispensed balls.

BACKGROUND OF THE INVENTION

Golf ball retrievers are well known devices in the prior art. Generally, such devices are intended for retrieving golf balls from such locations as fairways, practice greens, and the like. Retrievers generally comprise a hollow tube having an internal diameter slightly larger than a golf ball. The tube is connected at one end to an opening in the bottom wall of a container. The container is often referred to as a shag bag. The free end of the tube usually has means for capturing the golf ball within the tube so that when the free end of the tube is placed over a golf ball on the ground and pressure applied, the ball enters and is held in the tube so it does not exit through the free end. Once a golf ball is captured, the tube is ready to pick up the next ball. When inverted, the balls are transmitted through the tube and collected in the shag bag or other container for later use.

Devices for collecting and then dispensing golf balls one at a time are known, but have many disadvantages. Thus, Liu, et al., in U.S. Pat. No. 5,395,146, entitled Golf Ball Pick-Up Device, discloses a closed rigid container-like shag bag having a spiral pathway therein. The container is intended for receiving golf balls from the transmission tube. A horizontally disposed rotating disk-like slide is provided between the transmission tube, through the hole is the disk and into and the container. The slide has a hole in it. The bottom wall of the container has two holes. The slide has two positions. In the first position, a retrieved ball enters the first hole in the bottom wall from the transmission tube and into the container. To dispense a ball, the entire container must be inverted so that balls in the tube are sent through the first hole in the disk and collected in the container. The container is then returned to its upright position and the balls proceed down the spiral path to the second hole in the bottom wall of the container. To dispense the balls, the slide must be positioned so that the second hole of the container is in registry with the hole in the disk so that balls coming from the downward spiral of the container will enter the tube. In the wall of the tube, covering a dispensing hole in the side of the tube and adjacent the tube's free end, is a pivotally mounted cover. When the cover is opened, the cover blocks access from within the tube to its free or ball retrieving end and diverts dispensed balls out the cover. A disadvantage of this device is that it is highly cumbersome to use. The balls must traverse the tube when used as a retriever, enter the container, reach the top of the container, and, through physical inversion, be moved through the entire helical path within the container. To dispense requires positioning of the slide from the first to the second position in the proper sequence. If a ball is not in the proper position within the container, the process must be repeated. If not, all the balls are guided to the dispensing portion of the container, then more than one ball will be dispensed at a time.

Tiller, in U.S. Pat. No. 5,147,101 for Golf Ball Dispensing and Retrieving System, discloses a hollow tube for collecting and dispensing golf balls. The tube has a spring-loaded latch at one open end. Pressing the one open end against a golf ball causes the ball to pass the latch and enter the tube. The collected balls are held within the tube by the latch. To dispense a ball, the tube is placed at an angle to the ground with the open end at the ground. The latch is pressed to dispense a ball. One disadvantage of the Tiller device is that the amount of balls that may be stored is limited by the length of the tube. Another disadvantage is that dispensing a ball, using the latch, requires the user to bend to the ground to dispense a ball. Additionally, while dispensing will take place on perfectly level ground, such as an indoor surface, any uneven surface may block the opening the dispenser. The support taught by Tiller (a U-shaped stand) to hold the tube at angle is inherently unstable in uneven topographical settings such as out of doors.

Another device is disclosed by Fowler et al., in U.S. Pat. No. 2,962,321 for Device for Retrieving and Storing and Dispensing Golf Balls, in which the tube used to retrieve balls has a latch at the end so that the retrieved balls are retained and then may be dispensed by manipulating the latch. The disadvantage of this device is that the balls exit the same end of the tube through which they are retrieved. To dispense balls means that the entire tube, with the captured balls, must be elevated. This is can prove clumsy, particularly when the tube retains a great many balls. The device also requires a number of manipulative steps to work, including picking the tube up and holding it elevated while dispensing balls, then putting the device down so that the dispensed ball may be used.

SUMMARY OF THE INVENTION

It is an object of this invention to provide a golf retriever/dispenser to provide a device for efficiently retrieving and dispensing golf balls.

It is yet another object of this invention to provide a golf retriever/dispenser for reprieving golf balls through a first tube and dispensing the balls through a second tube.

It is still another object of this invention to provide a dispensing mechanism for selectively dispensing one ball at a time.

It is yet another object of this invention to provide a golf ball pick-up device that can be used as a golf ball dispenser.

In accordance with one of the teachings of this invention there is provided a golf ball collection and dispensing system of the type having a hollow container for receiving and dispensing therefrom golf balls for use upon a support or playing surface, the container has at least one hole in a wall thereof so dimensioned as to allow the collection or dispensing of golf balls. The system comprises first and second hollow transmission tube means being so dimensioned so as to receive therethrough golf balls. The first and second transmission tube means each have one end for being alternatively releasably connectable to the container and in communication with the container hole. The first transmission tube means having an opposed free end comprises means for receiving at least one golf ball at a time therein such that, upon a golf ball being inserted into the free end, the receiving means retains the golf ball and are capable of accepting therethrough and retaining therewithin the next golf ball. A second hollow transmission tube means is provided which comprises means for dispensing therefrom at least one golf ball at a time.

In yet another embodiment of this invention there is provided a dispensing means of the type which may be used to dispense rotatable objects such as, for example, balls having predetermined dimensions, in which the balls are passed through a tube or similar conduit. The dispensing means comprises the tube. There is also provided first and second blocking means for, in a first position, holding all balls from being dispensed from the free end of the tube and, in a second position, the blocking means selectively dispensing from the tube at least one ball at a time. There is further provided means for moving said first and second blocking means between said first position to said second position.

In still another novel aspect of this invention there is provided a device for dispensing balls of the type having a bag or container at one end for retaining balls and a conduit through which the balls are dispensed. The dispenser comprises a spike fixedly joined at one end of the dispenser for removably attaching the dispenser to a play surface to thereby provide stability for the dispenser.

The novel features of this invention, as well as the invention itself, both as to its structure and its operation, will be best understood from the accompanying drawing taken in conjunction with the accompanying description, in which similar reference characters refer to similar parts, and in which:

DETAILED DESCRIPTION OF THE INVENTION

Figure 2:
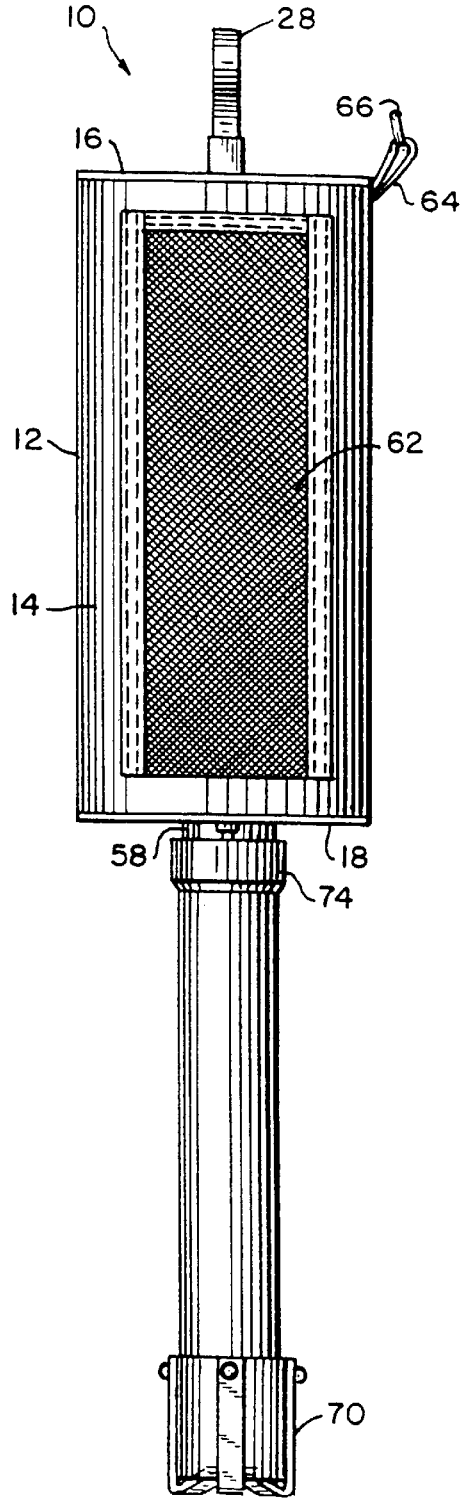
FIG. 2 is a side view of the ball retriever.
Figure 3:
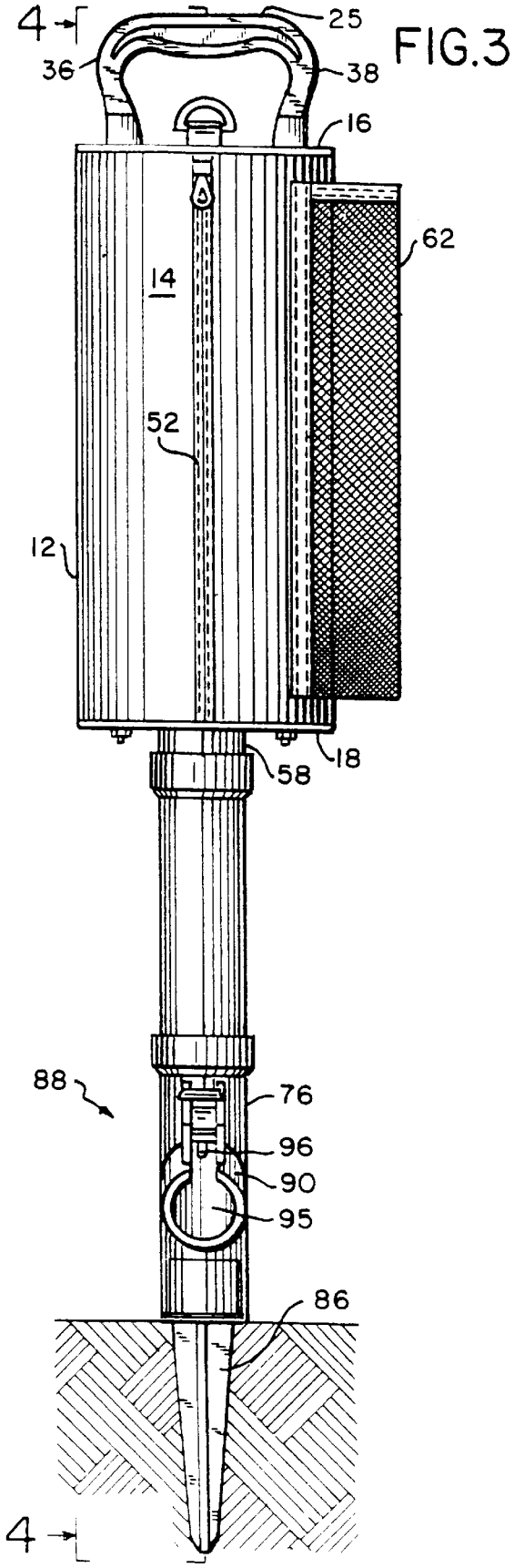
FIG. 3 is a side view of the ball dispenser mode of the invention.
Figure 4:
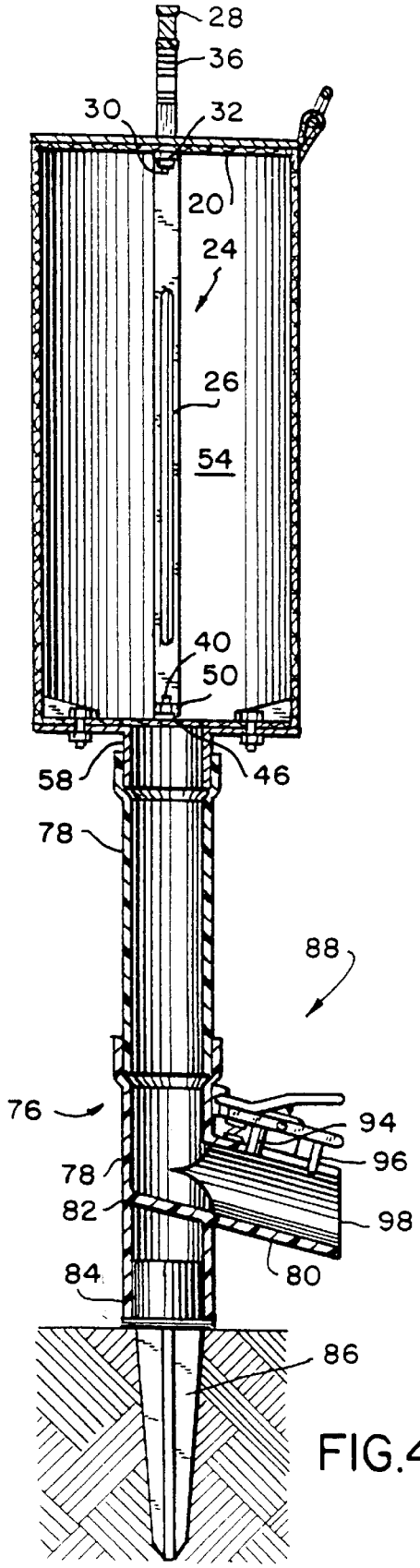
FIG. 4 is a section taken along line 4—4 and looking in the direction of the arrows in FIG. 3.
Figure 5:
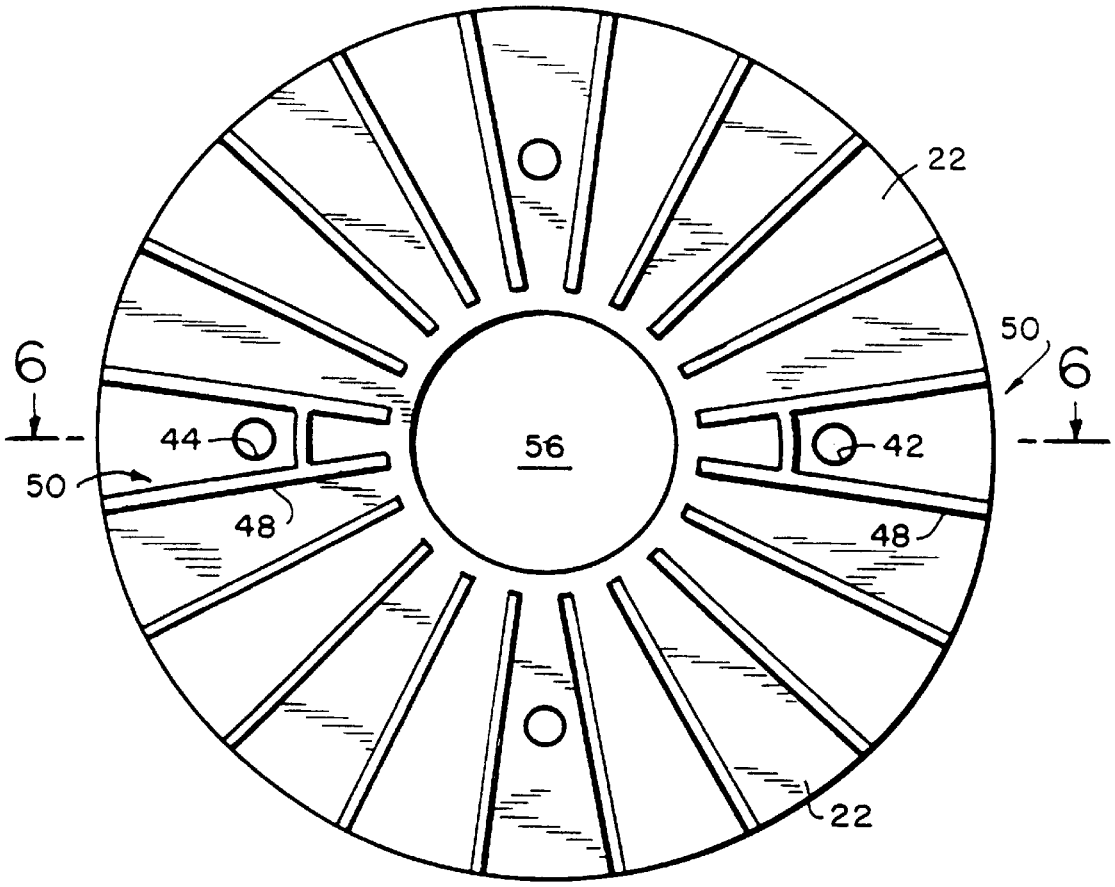
FIG. 5 is a bottom view of the golf ball holder.

In accordance with this invention there is provided a ball retriever/dispenser 10 (FIGS. 1–4) in which a golf shag bag 12 may comprise a generally cylindrical container 14 (FIGS. 1–4). The exterior wall 14 of the bag 12 may be made of a flexible fabric material, such as nylon or the like, or may be constructed of a rigid plastic. Integrally formed with the exterior cylindrical wall is a top wall 16 and bottom wall 18 of the same fabric or rigid material. These walls 14, 16, 18 form a container or shag bag for receiving golf balls. The shape of the bag 12 may be any desired shape and preferably cylindrical. The shape of the bag 12 may maintained by an upper and lower disks 20 and 22, respectively (FIG. 4). The exterior top and bottom walls 16 and 18 are generally the same dimensions as the disks 20 and 22. The disks 20, 22 may be made of any rigid material, such as plastic. Generally C-shaped side bars 24 (only one is visible in FIG. 4) having an elongated linear center section 26 provides support for the side wall 14 so that the side wall 14 maintains its generally cylindrical shape. A generally U-shaped handle 28, has screw threaded ends 30 which extend through apertures (not visible) in the top wall 16 of the bag 12, and through holes (not visible) in registry in the top disk 20 and a hole (not visible) in the bent end 32 of the C-shaped bar 24. Nuts 34 are used to secure the bolt ends 30 of each leg 36 and 38 of the top end 32 of the C-shaped bar 24, the top disk 20 and top fabric wall 16. In a similar fashion, threaded bolts 40 are inserted through apertures 42, 44 (FIGS. 5, 6) in the bottom disk 22 and through apertures (not visible) in the bottom ends 46 of the generally C-shaped bars 24. The two opposed C-shaped bars 24, secured to the top and bottom disks 20 and 22, maintain the cylindrical shape of the side wall 14 of the bag 12. The bottom disk 22 (FIGS. 5 and 6) may have extending right angle triangularly shaped fin elements 48 to give strength and rigidity to the bottom disk 22 and forming a directional path from the outer wall 14 toward the disk center. The ends 46 of each C-shaped bar 24 fit within two substantially parallel arranged fins 50 (FIG. 5) which are intended to properly orient the bottom ends 46 of the C-shaped bars 24.

Figure 1:
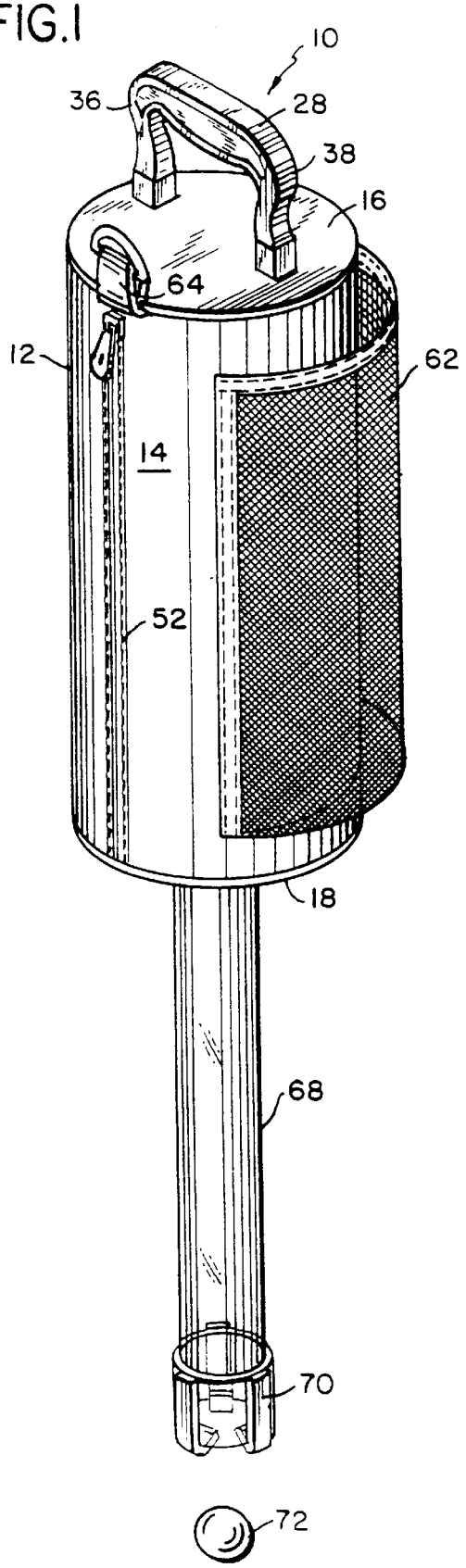
FIG. 1 is a perspective view of the ball retriever partially sectioned to show the retrieving of a golf ball and constructed in accordance with the teachings of the invention.

The cylindrical outer wall 14 of the bag 12 may have there through an opening closed by a vertically disposed zipper 52 (FIGS. 1 and 3) to provide access to the interior 54 (FIG. 4) of the bag 12. Attached to the outer wall 14 may be a container, such as, for example, a substantially rectangular net bag 62 secured thereto, as by stitching or the like, for receiving such articles as golf balls, Ts, or one of the tubes 68 or 74 (when such tube 68 or 74 is not in use), or the like (FIGS. 1–3). The bag 12 may also have attached thereto, as by stitching, an extending tang 64 with a hanging C-hook 66. The tang 64 with its hook 66 may be attached at the juncture of the top wall 16 and side wall 14, as is commonly known, for the purpose of hanging up the retriever/dispenser 10.

Figure 6:
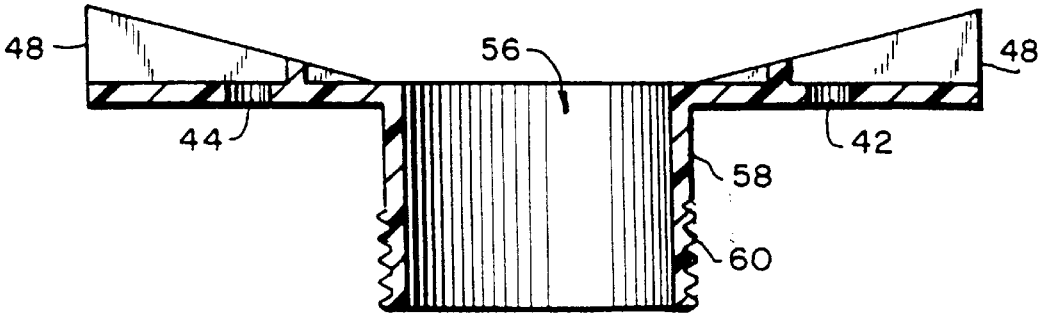
FIG. 6 is a section taken along line 6—6 in FIG. 5 and looking in the direction of the arrows.

The bottom disk 22 may have a centrally disposed circular aperture 56 sufficiently large enough to admit a golf ball. Integrally formed with the bottom disk and extending downwardly may be a golf ball dispensing and receiving collar 58 of sufficient diameter to permit the passage there through of one golf ball at a time. The exterior wall of the collar 58 may be threaded 60 (FIG. 6).

There is provided a golf ball retrieving tube 68, having a golf ball retriever mechanism 70 of well-known configuration at one end, for retrieving golf balls 72. The opposed end 74 may have an enlarged and internally threaded collar for being received by the threaded end 60 of the lower disk collar 58.

A dispensing tube 74 (FIGS. 3, 4, 7, and 8) may comprise a substantially L-shaped dispensing tube 76. The vertical leg 78 and laterally extending leg 80 of the L-shape dispenser 76 (i.e, the first and second legs 78, 80) may be joined as at an integrally formed elbow 82. The interior of the hollow tube 74 is so dimensioned that golf balls 72 may pass easily between the bag 12, past the elbow 82 and out the second or laterally extending dispensing leg 80. The dispensing leg 80 may extend downwardly at an acute angle from the horizontal to aid in the dispensing of balls 72. The vertical leg 78 may continue below the elbow 82 to form a dimensionally uniform vertical tube 84. The end of the tube 84 may be fixedly terminated in a spike 86 which is secured to the free lower end of thee tube 84 by attachment means such as screws or the like (not shown).

The dispenser tube 74 is provided with a dispenser mechanism 88. The mechanism 88 may comprise a slot 90 (FIG. 3) through the upper wall of the laterally extending second leg 80. The slot 90 may be spaced from the elbow 82 and may extend to the dispensing free end 98 of the leg 80. A substantially planar bar member 92, which may be made of any rigid material, such as plastic, may have two downwardly blocking means such as extending prongs 94 and 96. The prong 94, positioned closest to the elbow 82, is shorter than the prong 96 disposed closest to the dispensing end 98. Integrally formed on opposed sides of the slot 90 and to the upper portion 78 of the L-shaped dispensing tube and the laterally extending dispensing leg 80 may be two parallel support brackets 100. The bar 92 may be pivotally secured between the brackets 100 as by a pivot pin 102 which may be disposed between and substantially perpendicular to the prongs 94, 96. The rear most prong 94 extends into and adjacent the end of the slot 90 proximate the elbow 82. A spring 104 may have one end disposed on the upper surface 106 of the dispensing leg 80 and its opposed end abutting the underside of the end of the bar 92 adjacent the elbow 82. The spring 104 may be held in position as by engaging bosses molded into the respective outer surface 106 of the leg 80 and the bar 92. A lever arm 108 may be positioned above the bar 92 and pivotally secured to the brackets 100 as by a pivot pin 110 so that one end of the lever 108 engages the upper surface 112 of the bar 92 proximate the elbow 82.

The free upper end 114 of the L-shaped dispensing tube 76 may be fitted with a collar which is internally threaded 116 for engaging the threaded end 60 of the collar 58.

Figure 7:
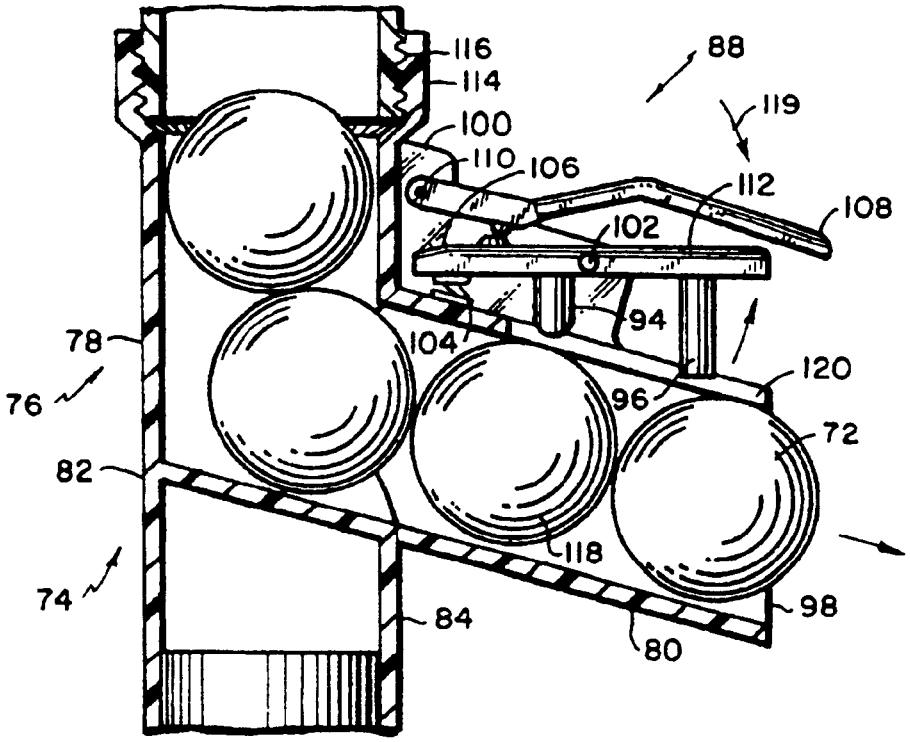
FIG. 7 is a section through the ball dispenser with the release mechanism in a ball dispensing position.
Figure 8:
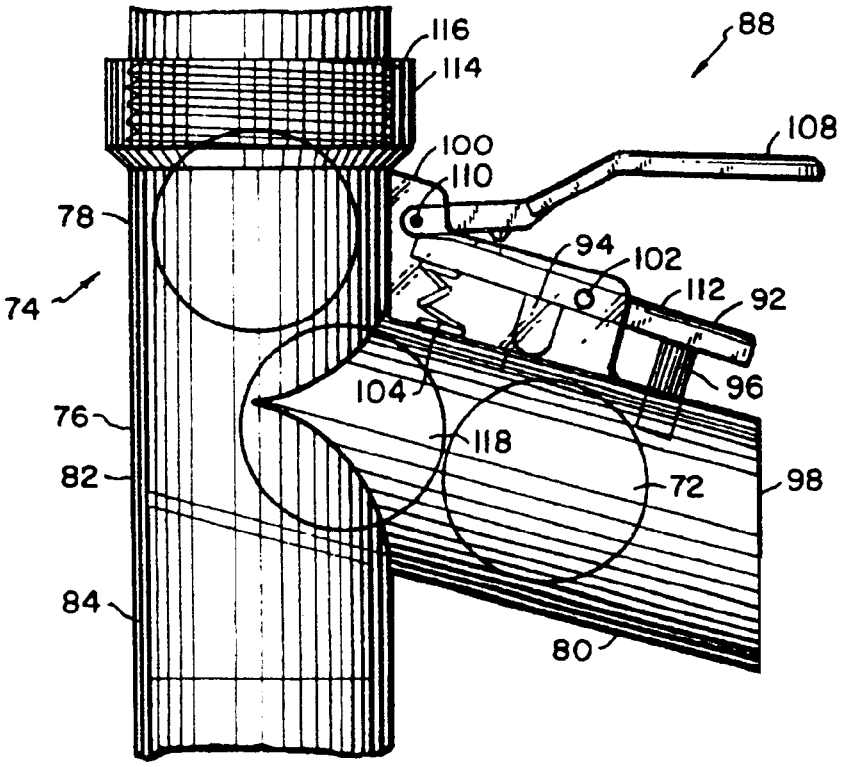
FIG. 8 is a section through the ball dispenser with the release mechanism preventing golf balls from being dispensed.

In operation, the golf ball retrieving tube 68 is releasably secured to the collar 58 by being threaded into position. Golf balls 72 are retrieved through the golf ball retrieving mechanism 70 in a manner well known in the art. Balls 72 are then stored in the bag 12 by inverting the tube and allowing the balls 72 to roll into the bag 12. When a desired number of balls 72 have been collected in the bag 12, the bag 12 is inverted and the retrieving tube 68 is unscrewed from the collar 58 and the dispensing tube 74 is screwed on in its place. The bag 12 is then set upright and the balls 72 fall through the central aperture 56 and are guided by the right angle fins 48 in the bottom disk 20 through the disk collar 58 and into the dispensing tube 76. The spike 86 is pushed into the ground to provide a steady positioning and securing means for the dispenser 10. The spike 86 also spaces the dispensing end 98 of the L-shaped dispenser from the ground. The balls 72 are prevented from leaving the L-shaped dispensing leg by the longer prong 96 of the pivotally mounted bar 92. To dispense a ball 72, the lever arm 108 is depressed at its forward end 116 in the direction of the arrow 119 (FIG. 7). This movement depresses the end 106 of the bar 92 adjacent the elbow 82, compressing the spring 104. The space between the prongs 94, 96 is such as to admit one ball 72 at a time. If desired, the space may be so dimensioned as to allow more than one ball so that more than one ball will be dispensed each time. The shorter prong 94 enters the slot 90 in the dispensing downward tube 80 just behind the ball 72 ready to be dispensed, blocking the ball 118 immediately behind it. The shorter prong 94, therefore, substantially simultaneously enters the interior of the second leg to hold the ball 118 back while the first ball 72 is dispensed because the longer prong 96 has been pivoted out of position. When the lever arm 108 is released, the spring 104 pushes up the end 106 of the bar 92, dropping the longer prong 96 into the slot 90 to thereby block the next ball 118 from being dispensed. The process is repeated each time the golfer wishes to have a ball dispensed and, as preferably configured, only one ball can be dispensed at a time.

When the golfer finishes using the retriever/dispenser, the dispensing tube 74 and retrieving tube 68 may be conveniently stored in the bag 12 by means of the zipper opening 52. Thus, the combination of all parts in the single dispenser 10 results in a self-contained and efficient retriever/dispenser.

While the particular golf ball dispensing and retrieving system, as well as the particular ball dispensing device, as herein shown and disclosed in detail is fully capable of obtaining the objects and advantages hereinbefore stated, it is to be understood that same is merely illustrative of the presently preferred embodiments of the invention and that no limitations are intended to the details of the construction or design herein shown other than is defined in the appended claims.

What is claimed is:

1. Means for dispensing rotatable objects in which the rotatable objects are passed through conduit means, the conduit means being of the type having a free end for dispensing the rotatable objects, said means for dispensing comprising:

a) first and second blocking means for selectively dispensing rotatable objects such that with said blocking means in a first position, said blocking means restraining the rotatable objects from being dispensed from the free end of the conduit and, in a second position, said blocking means dispensing at least one rotatable object;

b) lever means for moving with respect to said blocking means to move said blocking means from said first to said second position; and c) resilient means for returning said blocking means to said first position from said second position, wherein said resilient means engages the conduit means and said blocking means.

2. Dispensing means as recited in claim 1, wherein said lever means moves with respect to the conduit means.

3. Dispensing means as recited in claim 1, further comprising a spike removably joined at one end of the conduit means for removably attaching the dispensing means to a play surface to thereby provide stability for the dispensing means with reference to the play surface.

4. Dispensing means as recited in claim 1, wherein said lever means being pivotally secured to the conduit means.

5. Dispensing means as recited in claim 4, wherein said blocking means being pivotally secured to said conduit means.

6. Dispensing means as recited in claim 5, wherein a fulcrum of said lever means engages said blocking means.

7. Dispensing means as recited in claim 6, wherein said lever means pivot is spaced from said blocking means pivot.

8. Dispensing means as recited in claim 7, wherein said lever means comprises a lever arm secured at one end for said pivotal movement.

9. Dispensing means as recited in claim 8, wherein said resilient means comprises a spring, said spring being disposed between the conduit means and said blocking means and proximate said lever arm pivot.

10. A device for dispensing balls of the type having a bag or container at one end for retaining balls and a conduit through which the balls are dispensed; the device comprising: a spike removably joined at one end of the device for removably attaching the device to a play surface to thereby provide stability for the device, wherein the conduit of the device comprises a substantially L-shaped member such that when the device is secured to the play surface, a first leg of said L is vertical and is substantially perpendicular to the play surface and a second leg extends at an angle from said first leg and said first leg further comprises means for receiving said spike.

11. Means for dispensing rotatable objects in which the rotatable objects are selectively dispensed, the dispensing means comprising:

a) at least one conduit through which the rotatable objects are dispensed and at least a portion of which may be disposed substantially perpendicular to a play surface;

b) a spike having a first end removably securable to one end of said conduit such that the unsecured end comprises the end for securing in the play surface, said first end having a size equal to the inside of said conduit.

* * * * *